US007513320B2

(12) United States Patent
Mirchandani et al.

(10) Patent No.: US 7,513,320 B2
(45) Date of Patent: Apr. 7, 2009

(54) CEMENTED CARBIDE INSERTS FOR EARTH-BORING BITS

(75) Inventors: Prakash K. Mirchandani, Hampton Cove, AL (US); Alfred J. Mosco, Spring, TX (US)

(73) Assignee: TDY Industries, Inc., Pittsburgh, PA (US)

( * ) Notice: Subject to any disclaimer, the term of this patent is extended or adjusted under 35 U.S.C. 154(b) by 299 days.

(21) Appl. No.: 11/013,842

(22) Filed: Dec. 16, 2004

(65) Prior Publication Data

US 2006/0131081 A1 Jun. 22, 2006

(51) Int. Cl.
*E21B 10/00* (2006.01)

(52) U.S. Cl. ..... 175/426; 175/432

(58) Field of Classification Search ..... 175/426, 175/430, 432

See application file for complete search history.

(56) References Cited

U.S. PATENT DOCUMENTS

| | | | |
|---|---|---|---|
| 1,509,438 | A | 9/1924 | Miller |
| 1,530,293 | A | 3/1925 | Breitenstein |
| 1,808,138 | A | 6/1931 | Hogg et al. |
| 1,811,802 | A | 6/1931 | Newman |
| 1,912,298 | A | 5/1933 | Newman |
| 2,054,028 | A | 9/1936 | Benninghoff |
| 2,093,507 | A | 9/1937 | Bartek |
| 2,093,742 | A | 9/1937 | Staples |
| 2,093,986 | A | 9/1937 | Staples |
| 2,283,280 | A | 5/1942 | Nell |
| 2,819,958 | A | 1/1958 | Abkowitz et al. |
| 2,819,959 | A | 1/1958 | Abkowitz et al. |
| 2,906,654 | A | 9/1959 | Abkowitz |
| 2,954,570 | A | 10/1960 | Couch |
| 3,041,641 | A | 7/1962 | Hradek et al. |
| 3,368,881 | A | 2/1968 | Abkowitz et al. |
| 3,629,887 | A | 12/1971 | Urbanic |
| 3,660,050 | A | 5/1972 | Iler et al. |

(Continued)

FOREIGN PATENT DOCUMENTS

| | | |
|---|---|---|
| AU | 695583 | 2/1998 |

(Continued)

OTHER PUBLICATIONS

U.S. Appl. No. 11/206,368, filed Aug. 18, 2005 (65 pages).

(Continued)

*Primary Examiner*—William P Neuder
(74) *Attorney, Agent, or Firm*—Kirkpatrick & Lockhart Preston Gates Ellis LLP; Patrick J. Viccaro; John E. Grosselin, III

(57) ABSTRACT

This invention relates to cutting inserts for earth boring bits comprising a cutting zone, wherein the cutting zone comprises first cemented hard particles and a body zone, wherein the body zone comprises second cemented hard particles. The first cemented hard particles may differ in at least one property from the second cemented hard particles. As used herein, the cemented hard particles means a material comprising hard particles in a binder. The hard particles may be at least one of a carbide, a nitride, a boride, a silicide, an oxide, and solid solutions thereof and the binder may be at least one metal selected from cobalt, nickel, iron and alloys of cobalt, nickel or iron.

28 Claims, 12 Drawing Sheets

U.S. PATENT DOCUMENTS

| | | | |
|---|---|---|---|
| 3,757,879 | A | 9/1973 | Wilder et al. |
| 3,776,655 | A | 12/1973 | Urbanic |
| 3,782,848 | A | 1/1974 | Pfeifer |
| 3,806,270 | A | 4/1974 | Tanner et al. |
| 3,812,548 | A | 5/1974 | Theuerkaue |
| RE28,645 | E | 12/1975 | Aoki et al. |
| 3,987,859 | A | 10/1976 | Lichte |
| 4,017,480 | A | 4/1977 | Baum |
| 4,047,828 | A | 9/1977 | Makely |
| 4,094,709 | A | 6/1978 | Rozmus |
| 4,097,180 | A | 6/1978 | Kwieraga |
| 4,128,136 | A | 12/1978 | Generoux |
| 4,170,499 | A | 10/1979 | Thomas et al. |
| 4,198,233 | A | 4/1980 | Frehn |
| 4,221,270 | A | 9/1980 | Vezirian |
| 4,229,638 | A | 10/1980 | Lichte |
| 4,233,720 | A | 11/1980 | Rozmus |
| 4,255,165 | A | 3/1981 | Dennis et al. |
| 4,277,106 | A | 7/1981 | Sahley |
| 4,306,139 | A | 12/1981 | Shinozaki et al. |
| 4,325,994 | A | 4/1982 | Kitashima et al. |
| 4,341,557 | A | 7/1982 | Lizenby |
| 4,389,952 | A | 6/1983 | Dreier et al. |
| 4,396,321 | A | 8/1983 | Holmes |
| 4,398,952 | A | 8/1983 | Drake |
| 4,478,297 | A | 10/1984 | Radtke |
| 4,499,048 | A | 2/1985 | Hanejko |
| 4,499,795 | A | 2/1985 | Radtke |
| 4,526,748 | A | 7/1985 | Rozmus |
| 4,547,104 | A | 10/1985 | Holmes |
| 4,547,337 | A | 10/1985 | Rozmus |
| 4,550,532 | A | 11/1985 | Fletcher, Jr. et al. |
| 4,552,232 | A | 11/1985 | Frear |
| 4,554,130 | A | 11/1985 | Ecer |
| 4,562,990 | A | 1/1986 | Rose |
| 4,587,174 | A | 5/1986 | Yoshimura et al. |
| 4,592,685 | A | 6/1986 | Beere |
| 4,596,694 | A | 6/1986 | Rozmus |
| 4,597,730 | A | 7/1986 | Rozmus |
| 4,605,343 | A | 8/1986 | Hibbs, Jr. et al. |
| 4,609,577 | A | 9/1986 | Long |
| 4,630,693 | A | 12/1986 | Goodfellow |
| 4,656,002 | A | 4/1987 | Lizenby et al. |
| 4,662,461 | A | 5/1987 | Garrett |
| 4,667,756 | A | 5/1987 | King et al. |
| 4,686,080 | A | 8/1987 | Hara et al. |
| 4,686,156 | A | 8/1987 | Baldoni, II et al. |
| 4,694,919 | A | 9/1987 | Barr |
| 4,708,542 | A | 11/1987 | Emanuelli |
| 4,729,789 | A | 3/1988 | Ide et al. |
| 4,743,515 | A | 5/1988 | Fischer et al. |
| 4,744,943 | A | 5/1988 | Timm |
| 4,749,053 | A | 6/1988 | Hollingshead |
| 4,752,164 | A | 6/1988 | Leonard, Jr. |
| 4,809,903 | A | 3/1989 | Eylon et al. |
| 4,838,366 | A | 6/1989 | Jones |
| 4,871,377 | A | 10/1989 | Frushour |
| 4,884,477 | A | 12/1989 | Smith et al. |
| 4,889,017 | A | 12/1989 | Fuller et al. |
| 4,899,838 | A | 2/1990 | Sullivan et al. |
| 4,919,013 | A | 4/1990 | Smith et al. |
| 4,923,512 | A | 5/1990 | Timm et al. |
| 4,956,012 | A | 9/1990 | Jacobs et al. |
| 4,968,348 | A | 11/1990 | Abkowitz et al. |
| 4,991,670 | A | 2/1991 | Fuller et al. |
| 5,000,273 | A | 3/1991 | Horton et al. |
| 5,030,598 | A | 7/1991 | Hsieh |
| 5,032,352 | A | 7/1991 | Meeks et al. |
| 5,041,261 | A | 8/1991 | Buljan et al. |
| 5,049,450 | A | 9/1991 | Dorfman et al. |
| RE33,753 | E | 11/1991 | Vacchiano et al. |
| 5,067,860 | A | 11/1991 | Kobayashi et al. |
| 5,090,491 | A | 2/1992 | Tibbitts et al. |
| 5,092,412 | A | 3/1992 | Walk |
| 5,110,687 | A | 5/1992 | Abe et al. |
| 5,112,162 | A | 5/1992 | Hartford et al. |
| 5,112,168 | A | 5/1992 | Glimpel |
| 5,127,776 | A | 7/1992 | Glimpel |
| 5,161,898 | A | 11/1992 | Drake |
| 5,174,700 | A | 12/1992 | Sgarbi et al. |
| 5,179,772 | A | 1/1993 | Braun et al. |
| 5,186,739 | A | 2/1993 | Isobe et al. |
| 5,203,932 | A | 4/1993 | Kato et al. |
| 5,232,522 | A | 8/1993 | Doktycz et al. |
| 5,266,415 | A | 11/1993 | Newkirk et al. |
| 5,273,380 | A | 12/1993 | Musacchia |
| 5,281,260 | A | 1/1994 | Kumar et al. |
| 5,286,685 | A | 2/1994 | Schoennahl et al. |
| 5,311,958 | A | 5/1994 | Isbell et al. |
| 5,326,196 | A | 7/1994 | Noll |
| 5,333,520 | A | 8/1994 | Fischer et al. |
| 5,348,806 | A | 9/1994 | Kojo et al. |
| 5,373,907 | A | 12/1994 | Weaver |
| 5,376,329 | A | 12/1994 | Morgan et al. |
| 5,423,899 | A | 6/1995 | Krall et al. |
| 5,433,280 | A | 7/1995 | Smith |
| 5,443,337 | A | 8/1995 | Katayama |
| 5,452,771 | A | 9/1995 | Blackman et al. |
| 5,479,997 | A | 1/1996 | Scott et al. |
| 5,480,272 | A | 1/1996 | Jorgensen et al. |
| 5,482,670 | A | 1/1996 | Hong |
| 5,484,468 | A | 1/1996 | Östlund et al. |
| 5,487,626 | A | 1/1996 | Von Holst et al. |
| 5,506,055 | A | 4/1996 | Dorfman et al. |
| 5,518,077 | A | 5/1996 | Blackman et al. |
| 5,541,006 | A * | 7/1996 | Conley ..... 428/552 |
| 5,543,235 | A | 8/1996 | Mirchandani et al. |
| 5,544,550 | A | 8/1996 | Smith |
| 5,560,440 | A | 10/1996 | Tibbitts |
| 5,570,978 | A | 11/1996 | Rees et al. |
| 5,586,612 | A | 12/1996 | Isbell et al. |
| 5,590,729 | A | 1/1997 | Cooley et al. |
| 5,593,474 | A | 1/1997 | Keshavan et al. |
| 5,609,447 | A | 3/1997 | Britzke et al. |
| 5,611,251 | A | 3/1997 | Katayama |
| 5,612,264 | A | 3/1997 | Nilsson et al. |
| 5,628,837 | A | 5/1997 | Britzke et al. |
| 5,641,251 | A | 6/1997 | Leins et al. |
| 5,641,921 | A | 6/1997 | Dennis et al. |
| 5,662,183 | A | 9/1997 | Fang |
| 5,666,864 | A | 9/1997 | Tibbitts |
| 5,677,042 | A | 10/1997 | Massa et al. |
| 5,679,445 | A | 10/1997 | Massa et al. |
| 5,686,119 | A | 11/1997 | McNaughton, Jr. |
| 5,697,046 | A | 12/1997 | Conley |
| 5,697,462 | A | 12/1997 | Grimes et al. |
| 5,732,783 | A | 3/1998 | Truax et al. |
| 5,733,649 | A | 3/1998 | Kelley et al. |
| 5,733,664 | A | 3/1998 | Kelley et al. |
| 5,750,247 | A | 5/1998 | Bryant et al. |
| 5,753,160 | A | 5/1998 | Takeuchi et al. |
| 5,762,843 | A | 6/1998 | Massa et al. |
| 5,765,095 | A | 6/1998 | Flak et al. |
| 5,776,593 | A | 7/1998 | Massa et al. |
| 5,778,301 | A | 7/1998 | Hong |
| 5,789,686 | A | 8/1998 | Massa et al. |
| 5,792,403 | A | 8/1998 | Massa et al. |
| 5,806,934 | A | 9/1998 | Massa et al. |
| 5,830,256 | A | 11/1998 | Northrop et al. |
| 5,856,626 | A | 1/1999 | Fischer et al. |
| 5,865,571 | A | 2/1999 | Tankala et al. |
| 5,873,684 | A | 2/1999 | Flolo |
| 5,880,382 | A * | 3/1999 | Fang et al. ..... 75/236 |
| 5,890,852 | A | 4/1999 | Gress |

| | | | | |
|---|---|---|---|---|
| 5,897,830 | A | 4/1999 | Abkowitz et al. | |
| 5,957,006 | A | 9/1999 | Smith | |
| 5,963,775 | A | 10/1999 | Fang | |
| 5,967,249 | A | 10/1999 | Butcher | |
| 6,007,909 | A | 12/1999 | Rolander et al. | |
| 6,022,175 | A | 2/2000 | Heinrich et al. | |
| 6,029,544 | A | 2/2000 | Katayama | |
| 6,051,171 | A | 4/2000 | Takeuchi et al. | |
| 6,063,333 | A | 5/2000 | Dennis | |
| 6,068,070 | A | 5/2000 | Scott | |
| 6,073,518 | A | 6/2000 | Chow et al. | |
| 6,086,980 | A | 7/2000 | Foster et al. | |
| 6,089,123 | A | 7/2000 | Chow et al. | |
| 6,148,936 | A | 11/2000 | Evans et al. | |
| 6,200,514 | B1 | 3/2001 | Meister | |
| 6,209,420 | B1 | 4/2001 | Butcher et al. | |
| 6,214,134 | B1 | 4/2001 | Eylon et al. | |
| 6,214,287 | B1 | 4/2001 | Waldenström | |
| 6,220,117 | B1 | 4/2001 | Butcher | |
| 6,227,188 | B1 | 5/2001 | Tankala et al. | |
| 6,228,139 | B1 | 5/2001 | Oskarrson | |
| 6,241,036 | B1 | 6/2001 | Lovato et al. | |
| 6,254,658 | B1 | 7/2001 | Taniuchi et al. | |
| 6,287,360 | B1 | 9/2001 | Kembaiyan et al. | |
| 6,290,438 | B1 | 9/2001 | Papajewski | |
| 6,293,986 | B1 | 9/2001 | Rödiger et al. | |
| 6,299,658 | B1 * | 10/2001 | Moriguchi et al. | 51/307 |
| 6,374,932 | B1 | 4/2002 | Brady | |
| 6,375,706 | B2 | 4/2002 | Kembaiyan et al. | |
| 6,386,954 | B2 | 5/2002 | Sawabe et al. | |
| 6,395,108 | B2 | 5/2002 | Eberle et al. | |
| 6,425,716 | B1 | 7/2002 | Cook | |
| 6,453,899 | B1 | 9/2002 | Tselesin | |
| 6,454,025 | B1 | 9/2002 | Runquist et al. | |
| 6,454,028 | B1 | 9/2002 | Evans | |
| 6,454,030 | B1 | 9/2002 | Findley et al. | |
| 6,458,471 | B2 | 10/2002 | Lovato et al. | |
| 6,461,401 | B1 | 10/2002 | Kembaiyan et al. | |
| 6,474,425 | B1 | 11/2002 | Truax et al. | |
| 6,499,917 | B1 | 12/2002 | Parker et al. | |
| 6,499,920 | B2 | 12/2002 | Sawabe | |
| 6,500,226 | B1 | 12/2002 | Dennis | |
| 6,511,265 | B1 | 1/2003 | Mirchandani et al. | |
| 6,544,308 | B2 | 4/2003 | Griffin et al. | |
| 6,562,462 | B2 | 5/2003 | Griffin et al. | |
| 6,576,182 | B1 | 6/2003 | Ravagni et al. | |
| 6,585,064 | B2 | 7/2003 | Griffin et al. | |
| 6,589,640 | B2 | 7/2003 | Griffin et al. | |
| 6,599,467 | B1 | 7/2003 | Yamaguchi et al. | |
| 6,607,693 | B1 | 8/2003 | Saito et al. | |
| 6,655,481 | B2 | 12/2003 | Findley et al. | |
| 6,685,880 | B2 | 2/2004 | Engström et al. | |
| 6,688,988 | B2 | 2/2004 | McClure | |
| 6,719,074 | B2 * | 4/2004 | Tsuda et al. | 175/428 |
| 6,742,608 | B2 | 6/2004 | Murdoch | |
| 6,742,611 | B1 | 6/2004 | Illerhaus et al. | |
| 6,756,009 | B2 | 6/2004 | Sim et al. | |
| 6,764,555 | B2 | 7/2004 | Hiramatsu et al. | |
| 6,766,870 | B2 | 7/2004 | Overstreet | |
| 6,849,231 | B2 | 2/2005 | Kojima et al. | |
| 6,918,942 | B2 | 7/2005 | Hatta et al. | |
| 6,949,148 | B2 | 9/2005 | Sugiyama et al. | |
| 6,958,099 | B2 | 10/2005 | Nakamura et al. | |
| 7,014,719 | B2 | 3/2006 | Suzuki et al. | |
| 7,014,720 | B2 | 3/2006 | Iseda | |
| 7,044,243 | B2 | 5/2006 | Kembaiyan et al. | |
| 7,048,081 | B2 | 5/2006 | Smith et al. | |
| 7,070,666 | B2 | 7/2006 | Druschitz et al. | |
| 7,090,731 | B2 | 8/2006 | Kashima et al. | |
| 7,101,446 | B2 | 9/2006 | Takeda et al. | |
| 7,112,143 | B2 | 9/2006 | Muller | |
| 7,261,782 | B2 | 8/2007 | Hwang et al. | |
| 7,270,679 | B2 | 9/2007 | Istephanous et al. | |
| 2002/0004105 | A1 | 1/2002 | Kunze et al. | |
| 2003/0010409 | A1 | 1/2003 | Kunze et al. | |
| 2003/0041922 | A1 | 3/2003 | Hirose et al. | |
| 2003/0219605 | A1 | 11/2003 | Molian et al. | |
| 2004/0013558 | A1 | 1/2004 | Kondoh et al. | |
| 2004/0060742 | A1 | 4/2004 | Kembaiyan et al. | |
| 2004/0105730 | A1 | 6/2004 | Nakajima | |
| 2004/0196638 | A1 | 10/2004 | Lee et al. | |
| 2004/0245022 | A1 | 12/2004 | Izaguirre et al. | |
| 2004/0245024 | A1 | 12/2004 | Kembaiyan | |
| 2005/0000317 | A1 * | 1/2005 | Liang et al. | 75/241 |
| 2005/0008524 | A1 | 1/2005 | Testani | |
| 2005/0084407 | A1 | 4/2005 | Myrick | |
| 2005/0103404 | A1 | 5/2005 | Hsieh et al. | |
| 2005/0117984 | A1 | 6/2005 | Eason et al. | |
| 2005/0126334 | A1 * | 6/2005 | Mirchandani | 75/240 |
| 2005/0194073 | A1 | 9/2005 | Hamano et al. | |
| 2005/0211475 | A1 | 9/2005 | Mirchandani et al. | |
| 2005/0247491 | A1 | 11/2005 | Mirchandani et al. | |
| 2005/0268746 | A1 | 12/2005 | Abkowitz et al. | |
| 2006/0016521 | A1 | 1/2006 | Hanusiak et al. | |
| 2006/0024140 | A1 | 2/2006 | Wolff et al. | |
| 2006/0032677 | A1 | 2/2006 | Azar et al. | |
| 2006/0043648 | A1 | 3/2006 | Takeuchi et al. | |
| 2006/0057017 | A1 | 3/2006 | Woodfield et al. | |
| 2006/0060392 | A1 * | 3/2006 | Eyre | 175/434 |
| 2006/0131081 | A1 | 6/2006 | Mirchandani et al. | |
| 2006/0288820 | A1 | 12/2006 | Mirchandani et al. | |
| 2007/0102198 | A1 | 5/2007 | Oxford et al. | |
| 2007/0102199 | A1 | 5/2007 | Smith et al. | |
| 2007/0102200 | A1 | 5/2007 | Choe et al. | |
| 2007/0102202 | A1 | 5/2007 | Choe et al. | |
| 2007/0108650 | A1 | 5/2007 | Mirchandani et al. | |
| 2007/0163679 | A1 | 7/2007 | Fujisawa et al. | |
| 2007/0251732 | A1 | 11/2007 | Mirchandani et al. | |

FOREIGN PATENT DOCUMENTS

| | | | |
|---|---|---|---|
| CA | 2212197 | | 10/2000 |
| EP | 0157625 | A2 | 10/1985 |
| EP | 0264674 | A2 | 4/1988 |
| EP | 0453428 | A1 | 10/1991 |
| EP | 0641620 | B1 | 2/1998 |
| EP | 0995876 | A2 | 4/2000 |
| EP | 1065021 | A | 1/2001 |
| EP | 1106706 | A1 | 6/2001 |
| EP | 1244531 | B1 | 10/2004 |
| EP | 1686193 | A2 | 8/2006 |
| FR | 2627541 | A2 | 8/1989 |
| GB | 945227 | | 12/1963 |
| GB | 2158744 | A | 11/1985 |
| GB | 2218931 | A | 11/1989 |
| GB | 2324752 | A | 11/1998 |
| GB | 2385350 | A | 8/2003 |
| GB | 2393449 | A | 3/2004 |
| GB | 2397832 | A | 8/2004 |
| JP | 59-175912 | | 10/1984 |
| JP | 62-063005 | | 3/1987 |
| JP | 10 219385 | A | 8/1998 |
| WO | WO 92/22390 | A1 | 12/1992 |
| WO | WO 98/28455 | A1 | 7/1998 |
| WO | WO 00/043628 | A2 | 7/2000 |
| WO | WO 01/43899 | A1 | 6/2001 |
| WO | WO 03/011508 | A2 | 2/2003 |
| WO | WO 03/049889 | A2 | 6/2003 |
| WO | WO 2004/053197 | A2 | 6/2004 |
| WO | WO 2005/045082 | A1 | 5/2005 |
| WO | WO 2005/061746 | | 7/2005 |
| WO | WO 2005/106183 | A1 | 11/2005 |

WO WO 2006/071192 A1 7/2006

OTHER PUBLICATIONS

Deng, X et al., *Mechanical properties of a hybrid cemented carbide composite*, International Journal of Refractory Metals and Hard Materials, Elsevier Publishers, Barking, GB, vol. 19, No. 4-6, Jul. 2001, pp. 547-552.

Coyle, T.W. and A. Bahrami, "Structure and Adhesion of Ni and Ni-WC Plasma Spray Coatings," Thermal Spray, Surface Engineering via Applied Research, Proceedings of the 1st International Thermal Spray Conference, May 8-11, 2000, Montreal, Quebec, Canada, 2000, pp. 251-254.

Hayden, Matthew and Lyndon Scott Stephens, "Experimental Results for a Heat-Sink Mechanical Seal," Tribology Transactions, 48, 2005, pp. 352-361.

Peterman, Walter, "Heat-Sink Compound Protects the Unprotected," Welding Design and Fabrication, Sep. 2003, pp. 20-22.

Metals Handbook, vol. 16, Machining, "Tapping" (ASM International 1989), pp. 255-267.

Metals Handbook, vol. 16, Maching, "Cemented Carbides" (ASM International 1989), pp. 71-89.

U.S. Appl. No. 11/687,343, filed Mar. 16, 2007, (42 pages).

U.S. Appl. No. 11/945,372, filed Nov. 27, 2007, (49 pages).

U.S. Appl. No. 11/924,273, filed Oct. 25, 2007, (53 pages).

US 4,966,627, 10/1990, Keshavan et al. (withdrawn)

* cited by examiner

CEMENTED CARBIDE INSERTS FOR EARTH-BORING BITS

FIELD OF TECHNOLOGY

This invention relates to improvements to cutting inserts and cutting elements for earth-boring bits and methods of producing cutting inserts for earth-boring bits. More specifically, the invention relates to cemented hard particle cutting inserts for earth-boring bits comprising at least two regions of cemented hard particles and methods of making such cutting inserts.

BACKGROUND OF THE INVENTION

Earth-boring (or drilling) bits are commonly employed for oil and natural gas exploration, mining and excavation. Such earth-boring bits may have fixed or rotatable cutting elements. FIG. 1 illustrates a typical rotary cone earth-boring bit 10 with rotatable cutting elements 11. Cutting inserts 12, typically made from a cemented carbide, are placed in pockets fabricated on the outer surface of the cutting elements 11. Several cutting inserts 12 may be fixed to the rotatable cutting elements 11 in predetermined positions to optimize cutting.

The service life of an earth-boring bit is primarily a function of the wear properties of the cemented carbide inserts. One way to increase earth-boring bit service life is to employ cutting inserts made of materials with improved combinations of strength, toughness, and abrasion/erosion resistance.

As stated above, the cutting inserts may be made from cemented carbides, a type of cemented hard particle. The choice of cemented carbides for this application is predicated on the fact that these materials offer very attractive combinations of strength, fracture toughness, and wear resistance (i.e., properties that are extremely important to the efficient functioning of the boring or drilling bit). Cemented carbides are metal-matrix composites comprising carbides of one or more of the transition metals belonging to groups IVB, VB, and VIB of the periodic table (Ti, V, Cr, Zr, Nb, Mo, Hf, Ta, and W) as the hard particles or dispersed phase, and cobalt, nickel, or iron (or alloys of these metals) as the binder or continuous phase. Among the different possible hard particle-binder combinations, cemented carbides based on tungsten carbide (WC) as the hard particle, and cobalt as the binder phase, are the ones most commonly employed for earth-boring applications.

The properties of cemented carbides depend upon, among other properties, two microstructural parameters, namely, the average hard particle grain size and the weight or volume fraction of the hard particles or binder. In general, the hardness and wear resistance increases as the grain size decreases and/or the binder content decreases. On the other hand, fracture toughness increases as the grain size increases and/or the binder content increases. Thus there is a trade-off between wear resistance and fracture toughness when selecting a cemented carbide grade for any application. As wear resistance increases, fracture toughness typically decreases and vice versa.

FIGS. 2A-2E illustrate some of the different shapes and designs of the cemented carbide inserts typically employed in rotary cone earth-boring bits. Cutting inserts for earth-boring bits are typically characterized by the shape of the domed portion 22A-22E, such as, ovoid 22A (FIG. 2A), ballistic 22B (FIG. 2B), chisel 22C (FIG. 2C), multidome 22D (FIG. 2D), and conical 22E (FIG. 2E). The choice of the shape and cemented carbide grade employed depends upon the type of rock being drilled. Regardless of shape or size, all inserts have a dome portion, such as, 22A-22E and a body portion 21. The cutting action is performed by the dome portion 22A-22E, while the body portion 21 provides support for the dome portion 22A-22E. Most, or all, of the body portion 21 is embedded within the bit body or cutting element, and the body portion is typically inserted into the bit body by press fitting the cutting insert into a pocket.

As previously stated, the cutting action is primarily provided by the dome portion. The first portion of the dome portion to begin wearing away is the top half of the dome portion, and, in particular, the extreme tip of the dome portion. As the top of the dome portion begins to flatten out, the efficiency of cutting decreases dramatically since the earth is being removed by more of a rubbing action, as opposed to the more efficient cutting action. As rubbing action continues, considerable heat may be generated by the increase in friction, thereby resulting in the insert failing by thermal cracking and subsequent breakage. In order to retard wear at the tip of the dome, the drill bit designer has the choice of selecting a more wear resistant grade of cemented carbide from which to fabricate the inserts. However, as discussed earlier, the wear resistance of cemented carbides is inversely proportional to their fracture toughness. Hence, the drill bit designer is invariably forced to compromise between failure occurring by wear of the dome and failure occurring by breakage of the cutting insert. In addition, the cost of inserts used for earth-boring applications is relatively high since only virgin grades of cemented hard particles are employed for fabricating cutting inserts for earth-boring bits.

Accordingly, there is a need for improved cutting inserts for earth-boring bits having increased wear resistance, strength and toughness. Further, there is a need for lower cost cutting inserts.

SUMMARY OF PRESENT INVENTION

Embodiments of the cutting inserts for earth-boring bits of the present invention comprise at least two zones having different properties, such as hardness and fracture toughness. Embodiments of the present invention include earth-boring cutting inserts comprising at least a cutting zone, wherein the cutting zone comprises first cemented hard particles, and a body zone, wherein the body zone comprises second cemented hard particles. In a particular embodiment, the cutting zone may occupy a portion of the dome region while the body zone occupies the remainder of the dome region as well as all or part of the body region.

The first cemented hard particles differ in at least one property from the second cemented hard particles. As used herein, cemented hard particles means a material comprising a discontinuous phase of hard particles in a binder. The hard particles are "cemented" together by the binder. An example of cemented hard particles is a cemented carbide. The hard particles may be at least one of a carbide, a nitride, a boride, a silicide, an oxide, and solid solutions thereof and the binder may be at least one metal selected from cobalt, nickel, iron, and alloys of cobalt, nickel, or iron.

Further embodiments of the cutting insert for an earth-boring drill bit comprise a cutting zone and a body zone, wherein the at least one of the cutting zone and the body zone comprises a hybrid cemented carbide. In one embodiment, the cutting zone comprises a hybrid cemented carbide and the body zone comprises a conventional cemented carbide. Generally, a hybrid cemented carbide comprises a discontinuous phase of a first cemented carbide grade dispersed throughout a continuous phase of a second cemented carbide continuous phase.

The present invention is also directed to a method of preparing a cutting insert for an earth-boring bit. One embodiment of the method of the present invention comprises partially filling the mold with a first cemented hard particle powder, followed by filling the remaining volume of the mold with a second cemented hard particle powder, and then consolidating the two cemented hard particle powders as a single green compact. Another embodiment of the method of the present invention comprises consolidating a first cemented hard particle powder in a mold, thereby forming a first green compact and placing the first green compact in second mold, wherein the first green compact fills a portion of the second mold. The remaining portion of the second mold may then be filled with a second cemented hard particle powder and the second hard particle powder and the green compact may be further consolidated together to form a second green compact. The second green compact may then be sintered.

A further embodiment of the method of the present invention includes preparing a cutting insert for an earth-boring bit comprising pressing a first cemented carbide powder and a second cemented carbide powder in a mold to form a green compact, wherein at least one of the first cemented carbide powder and the second cemented carbide powder comprise a recycled cemented carbide powder, and sintering the green compact.

Unless otherwise indicated, all numbers expressing quantities of ingredients, time, temperatures, and so forth used in the present specification and claims are to be understood as being modified in all instances by the term "about." Accordingly, unless indicated to the contrary, the numerical parameters set forth in the following specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, may inherently contain certain errors necessarily resulting from the standard deviation found in their respective testing measurements.

The reader will appreciate the foregoing details and advantages of the present invention, as well as others, upon consideration of the following detailed description of embodiments of the invention. The reader also may comprehend such additional details and advantages of the present invention upon making and/or using embodiments within the present invention.

BRIEF DESCRIPTION OF THE FIGURES

The features and advantages of the present invention may be better understood by reference to the accompanying figures in which:

FIGS. 3*a*-3*e* illustrate an embodiment of a cutting insert 30 of the present invention as described in Example 1 wherein FIG. 3*a* is a photograph of a cross section of the cutting insert comprising a cutting zone 31 and a body zone 32; FIG. 3*b* is a photomicrograph of the cutting zone 31 of the cutting insert; FIG. 3*c* is a photomicrograph of a transition zone between the cutting zone 31 and the body zone 32 of the cutting insert; FIG. 3*d* is a photomicrograph of the body zone 32 of the cutting insert; FIG. 3*e* illustrates the exterior of the embodiment of a cutting insert for an earth-boring bit of the present invention comprising a cutting zone and a body zone;

FIGS. 4*a*-4*e* illustrate an embodiment of a cutting insert 40 of the present invention as described in Example 2 wherein FIG. 4*a* is a photograph of a cross section of the cutting insert comprising a cutting zone 41 and a body zone 42 ; FIG. 4*b* is a photomicrograph of the cutting zone 41 of the cutting insert; FIG. 4*c* is a photomicrograph of a transition zone between the cutting zone 41 and the body zone 42 of the cutting insert; FIG. 4*d* is a photomicrograph of the body zone 42 of the cutting insert; FIG. 4*e* illustrates the exterior of the embodiment of a cutting insert for an earth-boring bit of the present invention comprising a cutting zone and a body zone;

FIGS. 5*a*-5*e* illustrate an embodiment of a cutting insert 50 of the present invention as described in Example 3 wherein FIG. 5*a* is a photograph of a cross section of the cutting insert comprising a cutting zone 51 and a body zone 52 FIG. 5*b* is a photomicrograph of the cutting zone 51 of the cutting insert comprising a hybrid cemented carbide; FIG. 5*c* is a photomicrograph of a transition zone between the cutting zone 51 and the body zone 52 of the cutting insert; FIG. 5*d* is a photomicrograph of the body zone 52 of the cutting insert; FIG. 5*e* illustrates the exterior of the embodiment of a cutting insert for an earth-boring bit of the present invention comprising a cutting zone and a body zone;

FIGS. 6*a*-6*e* illustrate an embodiment of a cutting insert 60 of the present invention as described in Example 4 wherein FIG. 6*a* is a photograph of a cross section of the cutting insert comprising a cutting zone 61 and a body zone 62; FIG. 6*b* is a photomicrograph of the cutting zone 61 of the cutting insert; FIG. 6*c* is a photomicrograph of a transition zone between the cutting zone 61 and the body zone 62 of the cutting insert; FIG. 6*d* is a photomicrograph of the body zone 62 of the cutting insert; FIG. 6*e* illustrates the exterior of the embodiment of a cutting insert for an earth-boring bit of the present invention comprising a cutting zone and a body zone.

DESCRIPTION OF EMBODIMENTS OF THE INVENTION

Figure 1:
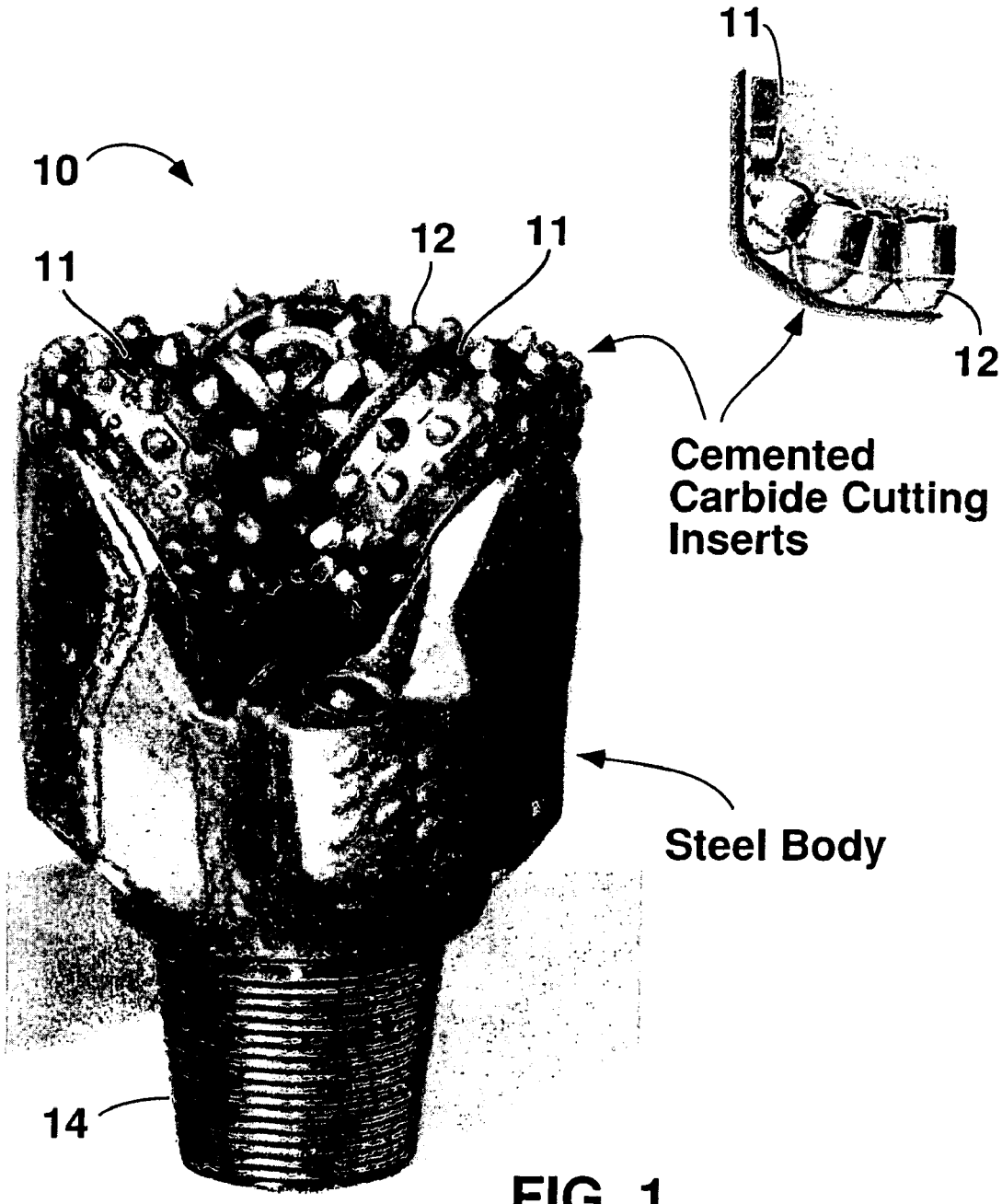
FIG. 1 illustrates a typical rotary cone earth-boring drill bit.
Figure 2A:
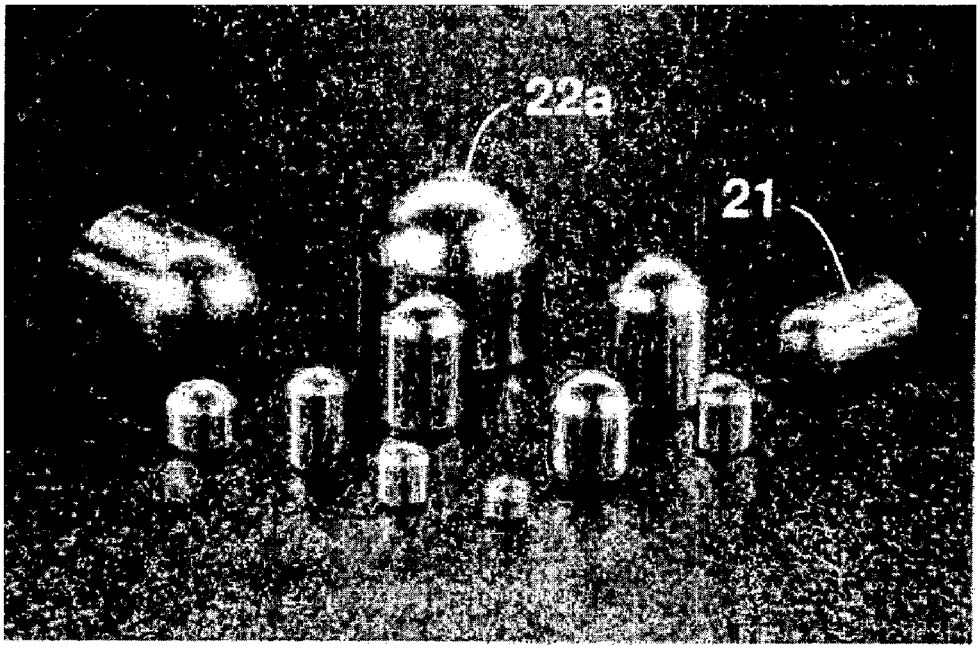
FIGS. 2*a*-2*e* illustrate different shapes and sizes of cutting inserts typically employed in rotary cone earth-boring bits such as ovoid (FIG. 2*a*), ballistic (FIG. 2*b*), chisel (FIG. 2*c*), multidome (FIG. 2*d*), and conical (FIG. 2*e*)
Figure 2B:
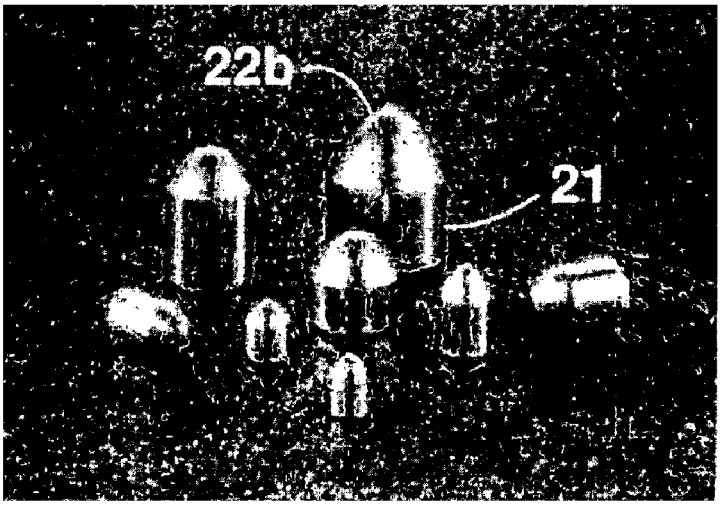
Figure 2C:
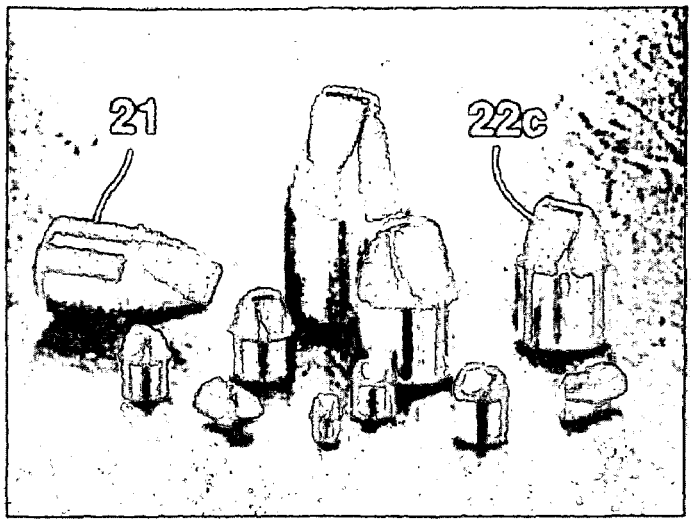
Figure 2D:
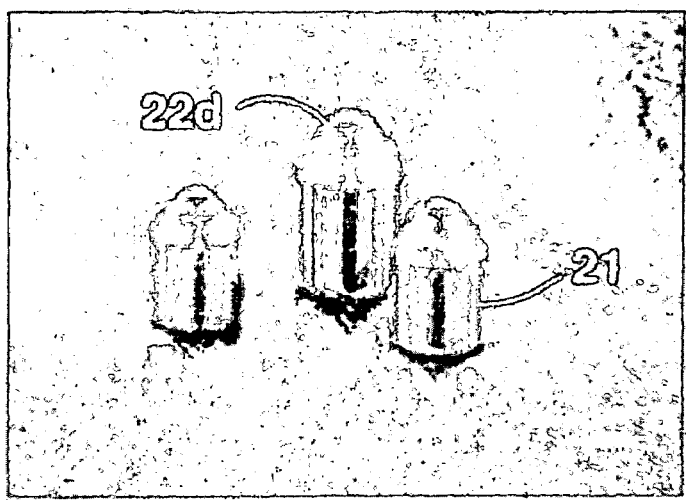
Figure 2E:
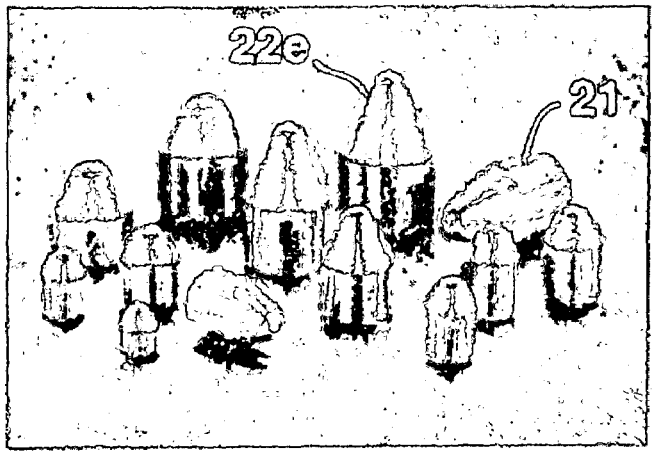

Embodiments of the present invention provide cutting inserts for earth-boring drill bits. Further embodiments of the cutting inserts of the present invention comprise at least two zones comprising cemented hard particles having different properties, such as, for example, wear resistance, hardness, fracture toughness, cost, and/or availability. The two zones may be for example, a cutting zone and a body zone. In such an embodiment, the cutting zone may comprise at least a portion of the dome region while the body zone may comprise at least a portion of the body region and may further comprise a portion of the dome region. Embodiments of the invention include various shapes and sizes of the multiple zones. For example, the cutting zone may be a portion of the dome regions having the shapes shown in FIGS. 2A-2E, which are ovoid (FIG. 2A), ballistic (FIG. 2B), chisel (FIG. 2C), multidome (FIG. 2D), and conical (FIG. 2E). Additional zones within the cutting inserts of the present invention may include central axis support zones, bottom zones, transitional zones or other zones that may enhance the properties of the cutting inserts for earth-boring drill bits. The various zones may be designed to provide, for example, improved wear characteristics, toughness, or self-sharpening characteristics to the cutting insert.

Figure 3A:
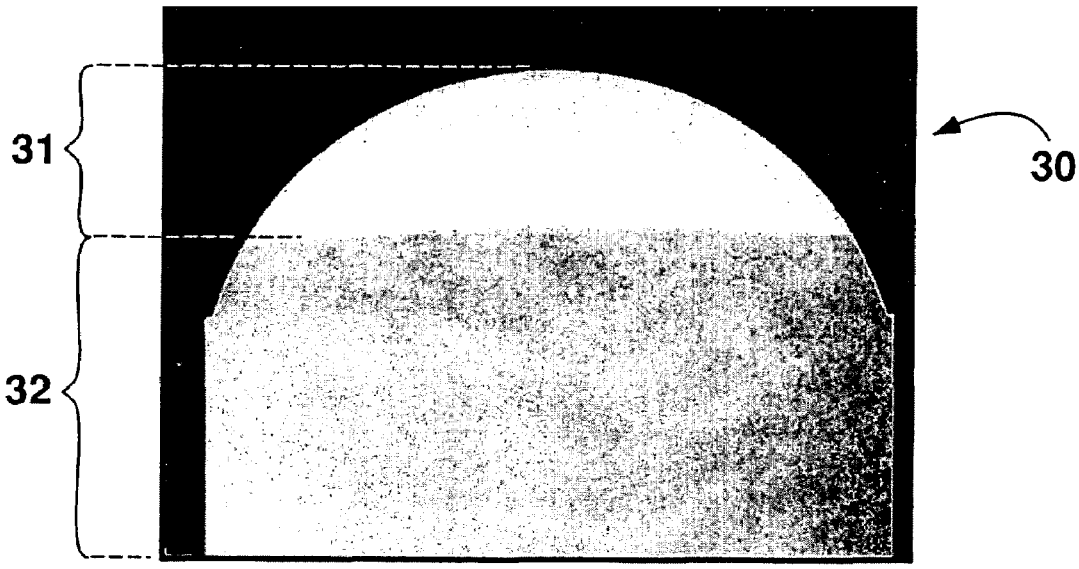
Figure 3E:
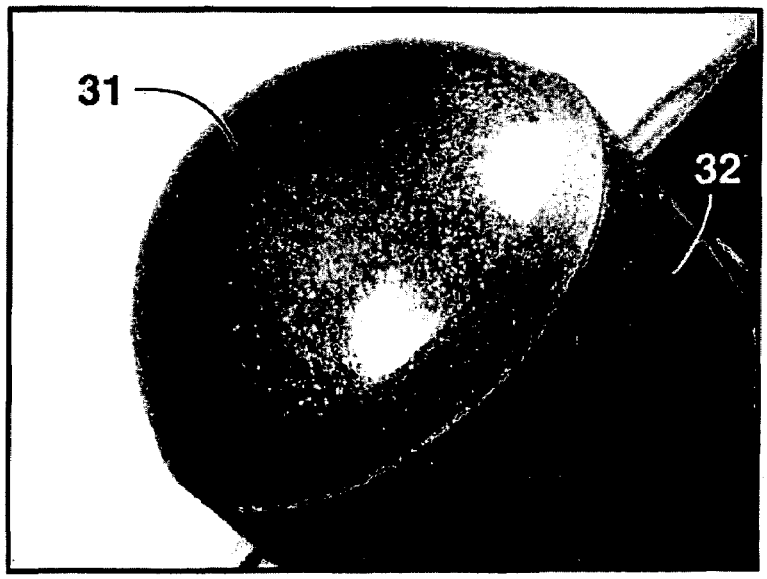
Figure 3B:
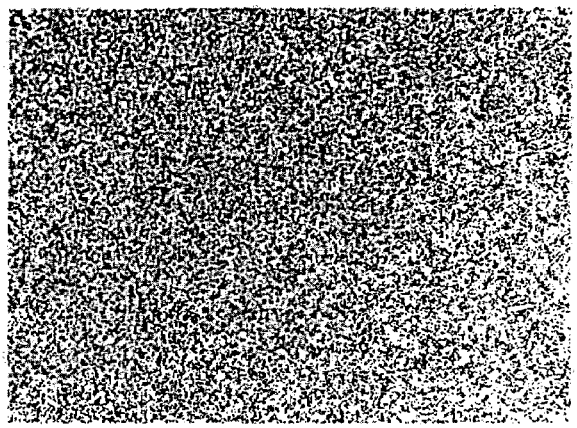
Figure 3C:
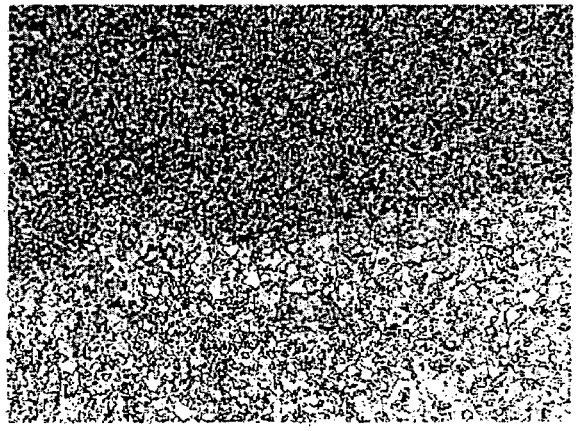
Figure 3D:
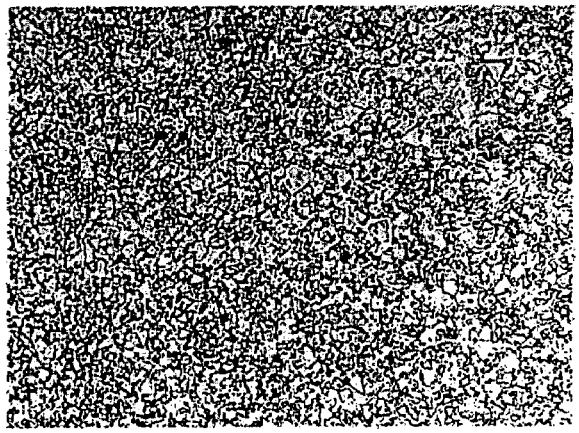

Embodiments of the earth-boring cutting inserts of the present invention comprise a cutting zone, wherein the cutting zone comprises first cemented hard particles and a body zone, wherein the body zone comprises second cemented hard particles. For example, FIGS. 3*a*-3*e* illustrate an embodiment of a cutting insert 30 of the present invention as prepared in Example 1. A cross section of the cutting insert 30 shows a cutting zone 31 and a body zone 32. FIG. 3*b* is a photomicrograph of the cutting zone 31 of the cutting insert comprising a first cemented carbide and FIG. 3*d* is a photomicrograph of the body zone 32 of the cutting insert comprising a second cemented carbide. The hard particles (i.e. the discontinuous phase) of the cemented hard particles may be selected from at least one of a carbide, a nitride, a boride, a silicide, an oxide, and solid solutions thereof.

Figure 4A:
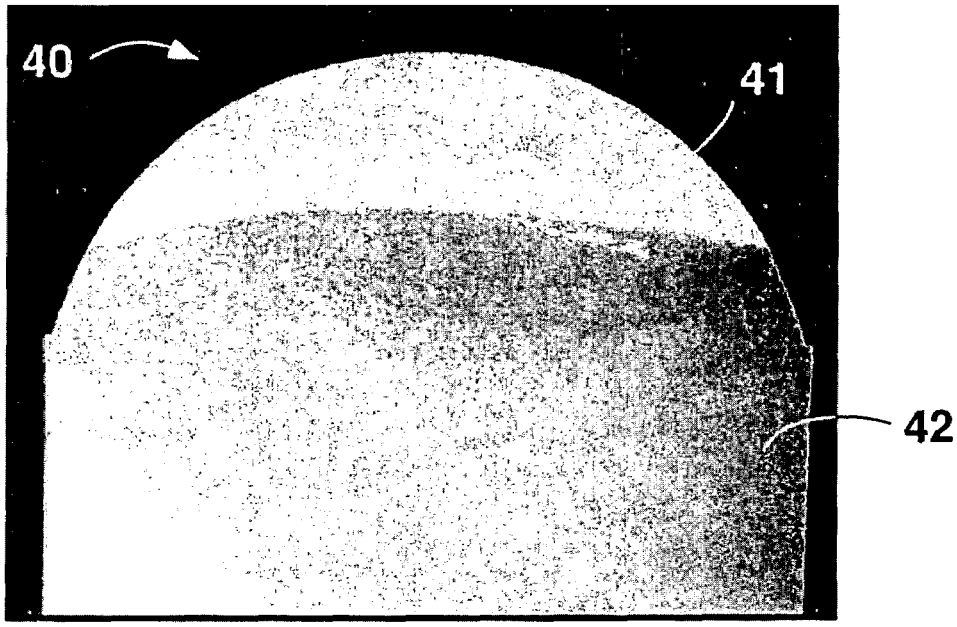
Figure 4E:
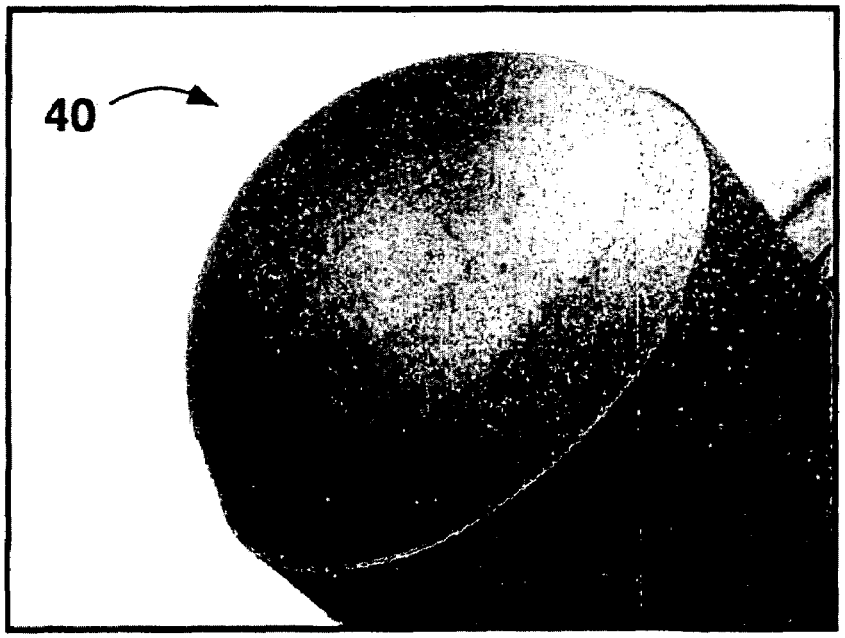
Figure 4B:
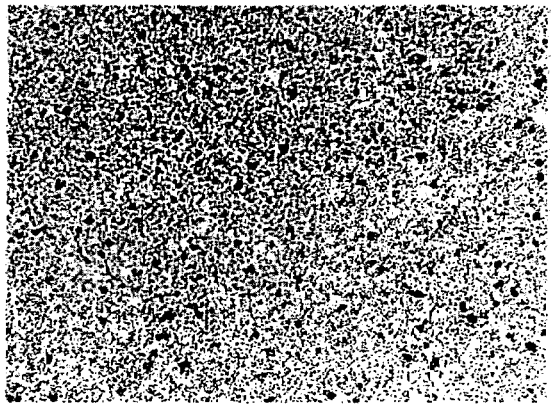
Figure 4C:
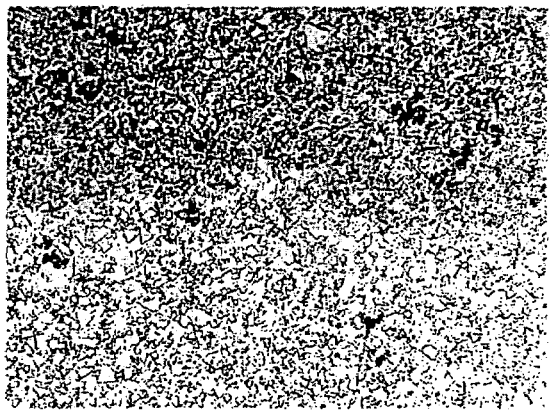
Figure 4D:
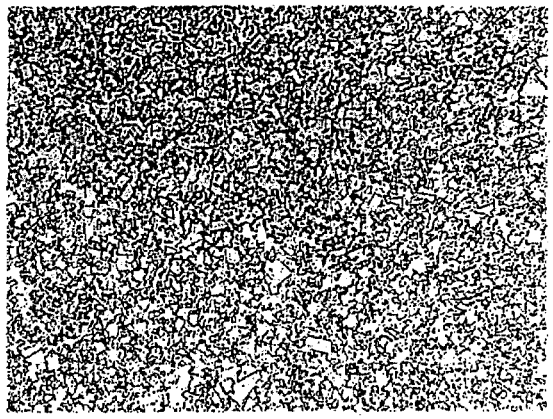

FIGS. 4*a*-4*e* illustrate a further embodiment of a cutting insert 40 of the present invention as prepared in Example 2. The embodiment of FIGS. 4*a*-4*e* comprises different cemented carbides than the embodiment of FIGS. 3*a*-3*e*. FIG. 3*a* is a cross section of the cutting insert 40 showing a cutting zone 41 and a body zone 42. FIG. 4*b* is a photomicrograph of the cutting zone 41 of the cutting insert comprising a first cemented carbide. FIG. 4*d* is a photomicrograph of the body zone 32 of the cutting insert comprising a second cemented carbide.

In embodiments wherein the cemented hard particles in the two or more zones of the cutting insert are different cemented carbides, the cemented carbide materials in the cutting zone and/or body zone may include carbides of one or more elements belonging to groups IVB through VIB of the periodic table. Preferably, the cemented carbides comprise at least one transition metal carbide selected from titanium carbide, chromium carbide, vanadium carbide, zirconium carbide, hafnium carbide, tantalum carbide, molybdenum carbide, niobium carbide, and tungsten carbide. The carbide particles preferably comprises about 60 to about 98 weight percent of the total weight of the cemented carbide material in each region. The carbide particles are embedded within a matrix of a binder that preferably constitutes about 2 to about 40 weight percent of the total weight of the cemented carbide within each zone in each zone.

The binder of the cemented hard particles may comprise at least one of cobalt, nickel, iron, or alloys of these elements. The binder also may comprise, for example, elements such as tungsten, chromium, titanium, tantalum, vanadium, molybdenum, niobium, zirconium, hafnium, and carbon up to the solubility limits of these elements in the binder. Additionally, the binder may contain up to 5 weight percent of elements such as copper, manganese, silver, aluminum, and ruthenium. One skilled in the art will recognize that any or all of the constituents of the cemented hard particle material may be introduced in elemental form, as compounds, and/or as master alloys. Preferably, the cutting zone and the body zone independently comprise different cemented carbides comprising tungsten carbide in a cobalt binder. The different cemented hard particles have at least one property that is different than at least one other cemented hard particle in the cutting insert for the drilling bit.

Embodiments of the cutting insert may also include hybrid cemented carbides, such as, but not limited to, any of the hybrid cemented carbides described in copending U.S. patent application Ser. No. 10/735,379, which is hereby incorporated by reference in its entirety. Generally, a hybrid cemented carbide is a material comprising particles of at least one cemented carbide grade dispersed throughout a second cemented carbide continuous phase, thereby forming a composite of cemented carbides. The hybrid cemented carbides of U.S. patent application Ser. No. 10/735,379 have low contiguity ratios and improved properties relative to other hybrid cemented carbides. Preferably, the contiguity ratio of the dispersed phase of a hybrid cemented carbide may be less than or equal to 0.48. Also, a hybrid cemented carbide composite of the present invention preferably has a dispersed phase with a hardness greater than the hardness of the continuous phase. For example, in certain embodiments of the hybrid cemented carbides used in one or more zones of cutting inserts of the present invention, the hardness of the dispersed phase is preferably greater than or equal to 88 HRA and less than or equal to 95 HRA, and the hardness of the continuous phase is greater than or equal to 78 and less than or equal to 91 HRA.

Additional embodiments or the cutting insert according to the present invention may include hybrid cemented carbide composites comprising a first cemented carbide dispersed phase wherein the volume fraction of the dispersed phase is less than 50 volume percent and a second cemented carbide continuous phase, wherein the contiguity ratio of the dispersed phase is less than or equal to 1.5 times the volume fraction of the dispersed phase in the composite material.

FIG. 5 shows an embodiment of a cutting insert of the present invention comprising a cutting zone 51 made of a hybrid cemented carbide. The cemented carbides of the hybrid cemented carbide of the cutting zone comprise tungsten carbide in cobalt. The dispersed phase of a hybrid cemented carbide comprises a first cemented carbide grade and continuous phase of a second cemented carbide. The first cemented carbide comprises 35 weigh percent of the total hybrid cemented carbide in the cutting zone 51. The first cemented carbide grade has a cobalt content of 10 weight percent, an average grain size of 0.8 μm, and a hardness of 92.0 HRA. The second cemented carbide grade of the hybrid cemented carbide comprises the remaining 65 weight percent of the cutting zone 51 and is a cemented carbide grade having a cobalt content of 10 weight percent, an average WC grain size of 3.0 μm, and a hardness of 89.0 HRA.

Figure 5A:
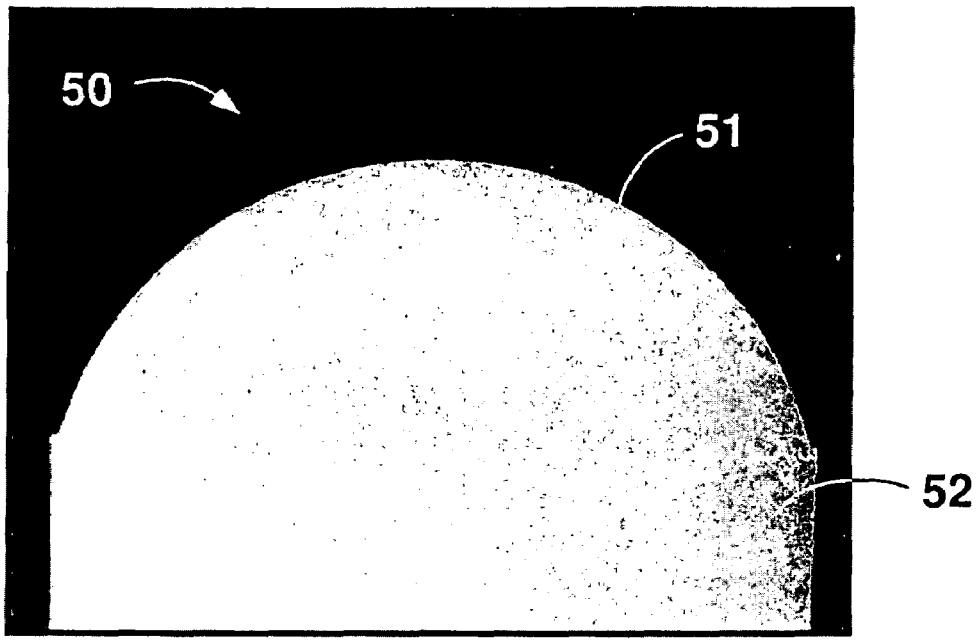
Figure 5E:
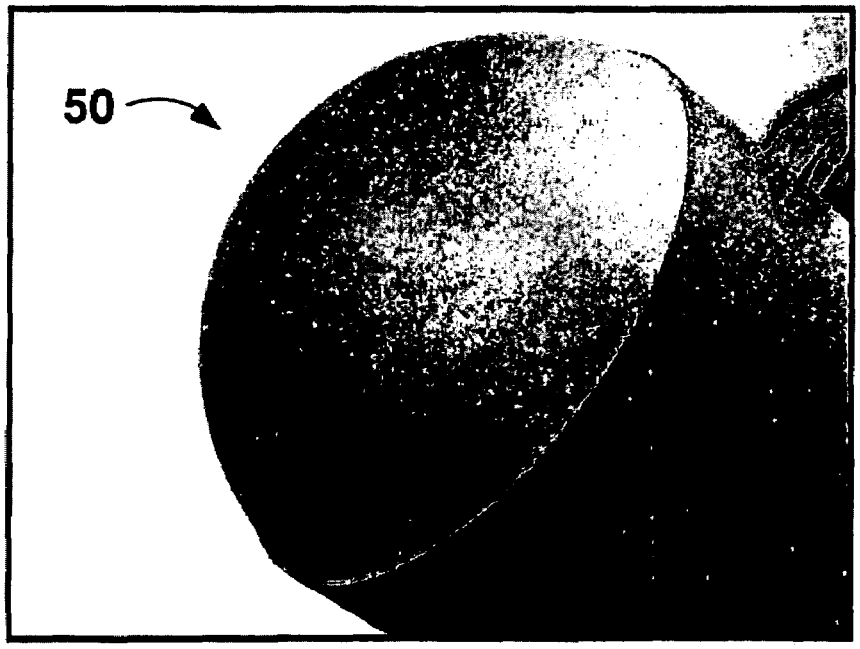
Figure 5B:
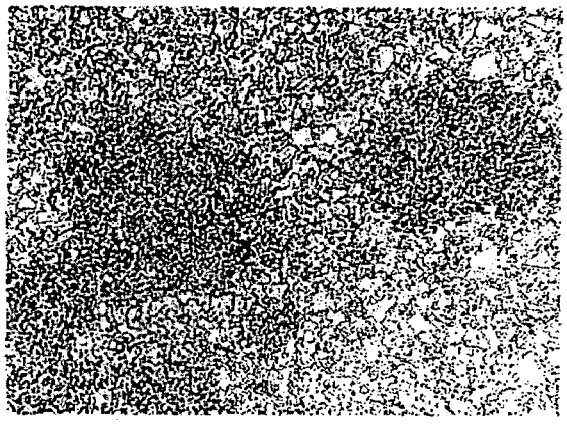
Figure 5C:
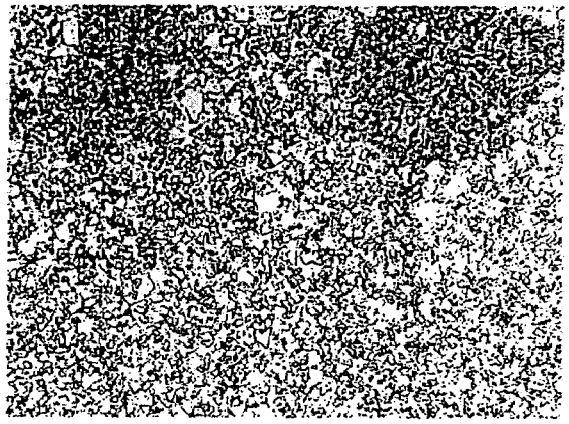
Figure 5D:
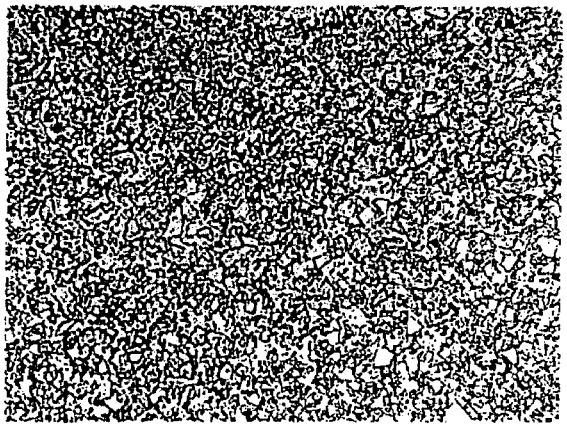
Figure 6A:
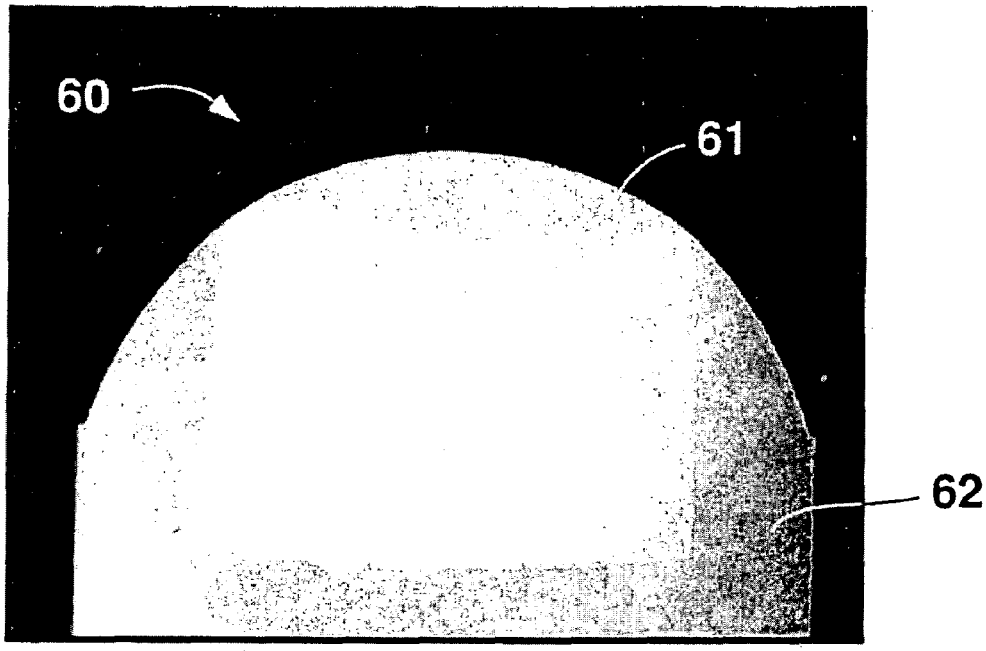
Figure 6E:
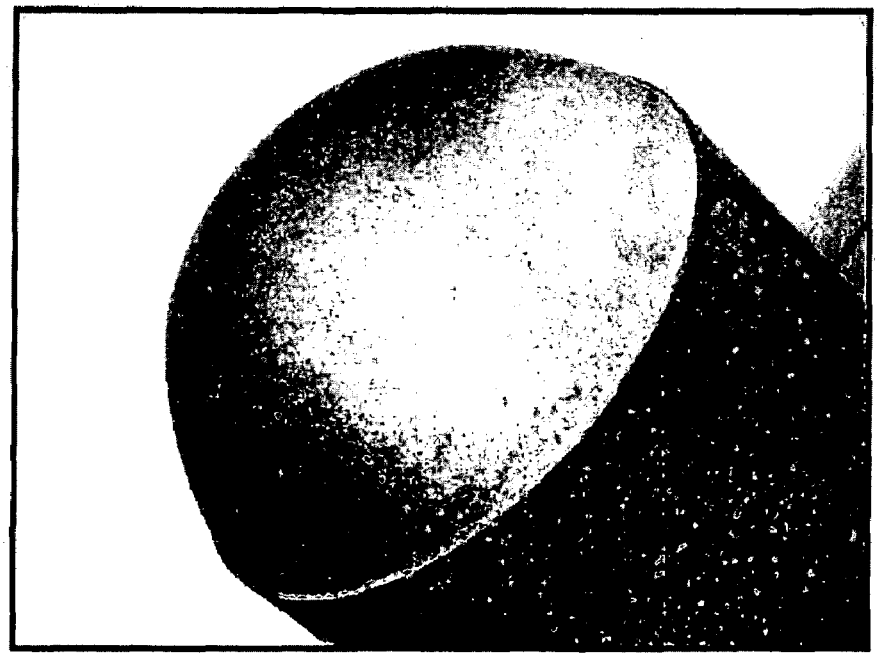
Figure 6B:
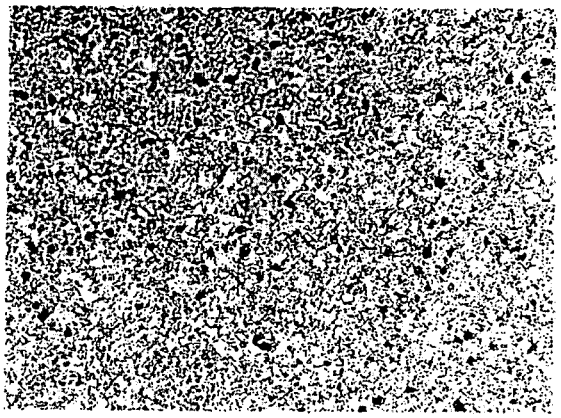
Figure 6C:
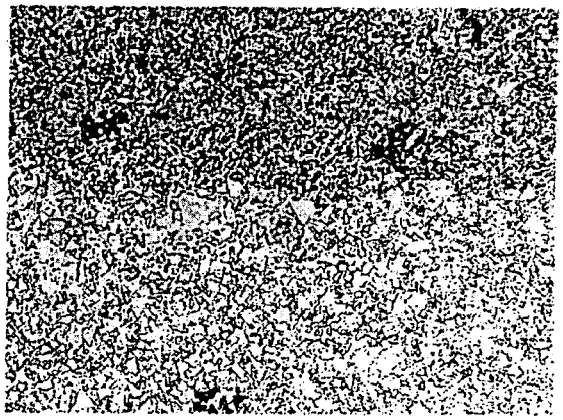
Figure 6D:
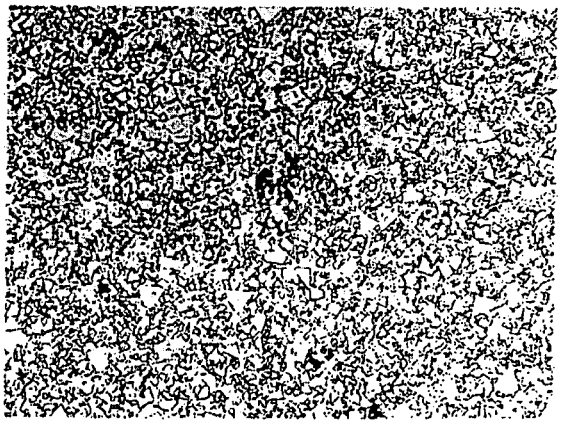

FIGS. 5*a*-5*e* illustrate an embodiment of a cutting insert 50 of the present invention as described in Example 3 wherein FIG. 5*a* is a photograph of a cross section of the cutting insert comprising a cutting zone 51 and a body zone 52; FIG. 5*b* is a photomicrograph of the cutting zone 51 of the cutting insert comprising a hybrid cemented carbide; FIG. 5*c* is a photomicrograph of a transition zone between the cutting zone 51 and the body zone 52 of the cutting insert; FIG. 5*d* is a photomicrograph of the body zone 52 of the cutting insert; FIG. 5*e* illustrates the exterior of the embodiment of a cutting insert for an earth-boring bit of the present invention comprising a cutting zone and a body zone.

The body zone 52 of the cutting insert 50 of FIG. 5(*a*) comprises a cemented carbide grade having a cobalt content of 10 weigh percent and an average WC grain size of 3.0 μm. The resultant body zone 62 has a hardness of 89.0 HRA.

This invention relates to cutting inserts having novel microstructures that allow for tailoring the wear resistance and toughness levels at different zones of regions of the insert. In this manner it is possible to provide improved combinations of wear resistance and toughness compared to "monolithic" inserts (i.e., inserts made from a single grade of cemented carbide, and thus having the same properties at all locations within the insert). This invention also relates to inserts made from combinations of cemented carbide grades to achieve cost reductions. This invention relates not only to the design of the inserts, but also to the manufacturing processes employed to fabricate the inserts.

In the preferred embodiments of this invention, a cutting zone of the cutting insert has a hardness (or wear resistance) that is greater than that of a body zone. It will be understood, however, that any combination of properties may be engineered into embodiments of the present invention by selection of zones and suitable materials in the zones.

The manufacturing process for articles of cemented hard particles typically comprises blending or mixing a powdered metal comprising the hard particles and a powdered metal comprising the binder to form a metallurgical powder blend. The metallurgical powder blend may be consolidated or pressed to form a green compact. See Example 4. The green compact is then sintered to form the article or a portion of the article having a solid monolithic construction. As used herein, an article or a region of an article has a monolithic construction if it is composed of a material, such as, for example, a cemented carbide material, having substantially the same characteristics at any working volume within the article or region. Subsequent to sintering, the article may be appropriately machined to form the desired shape or other features of the particular geometry of the article.

For example, the metallurgical powder blend may be consolidated by mechanically or isostatically compressing to form the green compact. The green compact is subsequently sintered to further densify the compact and to form an autogenous bond between the regions or portions of the article. Preferably, the compact is over pressure sintered at a pressure of 300-2000 psi and at a temperature of 1350-1500° C.

Embodiments of the present invention include methods of producing the cutting inserts for drilling bits or earth-boring bits. One such method includes placing a first metallurgical powder into a first region of a void of a mold. A second metallurgical powder blend may placed into a second region of the void of the mold. Depending on the number of regions of different cemented hard particle or cemented carbide materials desired in the cutting insert, the mold may be partitioned into additional regions in which additional metallurgical powder blends may be disposed. For example, the mold may be segregated into regions by placing one or more physical partitions in the void of the mold to define the several regions, or by merely filling the portions of the mold without providing a partition. The metallurgical powders are chosen to achieve the desired properties of the corresponding regions of the cutting as described above. The powders with the mold are then mechanically or isostatically compressed at the same time to densify the metallurgical powders together to form a green compact of consolidated powders. The method of preparing a sintered compact provides a cutting insert that may be of any shape and have any other physical geometric features. Such advantageous shapes and features may be understood to those of ordinary skill in the art after considering the present invention as described herein.

A further embodiment of the method of the present invention comprises consolidating a first cemented carbide powder in a mold forming a first green compact and placing the first green compact in second mold, wherein the first green compact fills a portion of the second mold. The second mold may be at least partially filled with a second cemented carbide powder. The second cemented carbide powder and the first green compact may be consolidated to form a second green compact. Finally, the second green compact is sintered. For example, the cutting insert 60 of FIG. 6 comprises a cutting zone 61 and a body zone 62. The cutting zone 61 was prepared by consolidating a first cemented carbide into a green compact. The green compact was then surrounded by a second cemented carbide powder to form the body zone 62. The first green compact and the second cemented carbide powder were consolidated together to form a second green compact. The resulting second green compact may then be sintered to further densify the compact and to form an autogenous bond between the body zone 62 and the cutting zone 61, and, if present, other cemented carbide regions. If necessary, the first green compact may be presintered up to a temperature of about 1200° C. to provide strength to the first green compact.

Such embodiments of the method of the present invention provide the cutting insert designer increased flexibility in design of the different zones for particular applications. The first green compact may be designed in any desired shape from any desired cemented hard particle material. In addition, the process may be repeated as many times as desired, preferably prior to sintering. For example, after consolidating to form the second green compact, the second green compact may be placed in a third mold with a third powder and consolidated to form a third green compact. By such a repetitive process, more complex shapes may be formed, cutting inserts including multiple clearly defined regions of differing properties may be formed, and the cutting insert designer will be able to design cutting inserts with specific wear capabilities in specific zones or regions.

One skilled in the art would understand the process parameters required for consolidation and sintering to form cemented hard particle articles, such as cemented carbide cutting inserts. Such parameters may be used in the methods of the present invention, for example, sintering may be performed at a temperature suitable to densify the article, such as at temperatures up to 1500° C.

As stated above, the cutting action of earth-boring bits is primarily provided by the dome area. The first region of the dome to begin wearing away is typically the top half of the dome, and, in particular, the extreme tip of the dome. As the top of the dome begins to flatten out, the efficiency of cutting decreases dramatically since the earth is being removed by a rubbing action as opposed to a cutting action. The cost of inserts used for earth-boring applications is relatively high since only virgin powder grades are employed for fabricating inserts. Considering that less than 25% of the volume of the inserts (i.e., the dome) is actually involved in the cutting action, the present inventors recognize that there is clearly an opportunity for significant cost reduction if the body zone could be made from a cheaper powder grade (using recycled materials, for example), as long as there is no reduction in strength in the zone separating the dome and the body zone.

Figure 7:
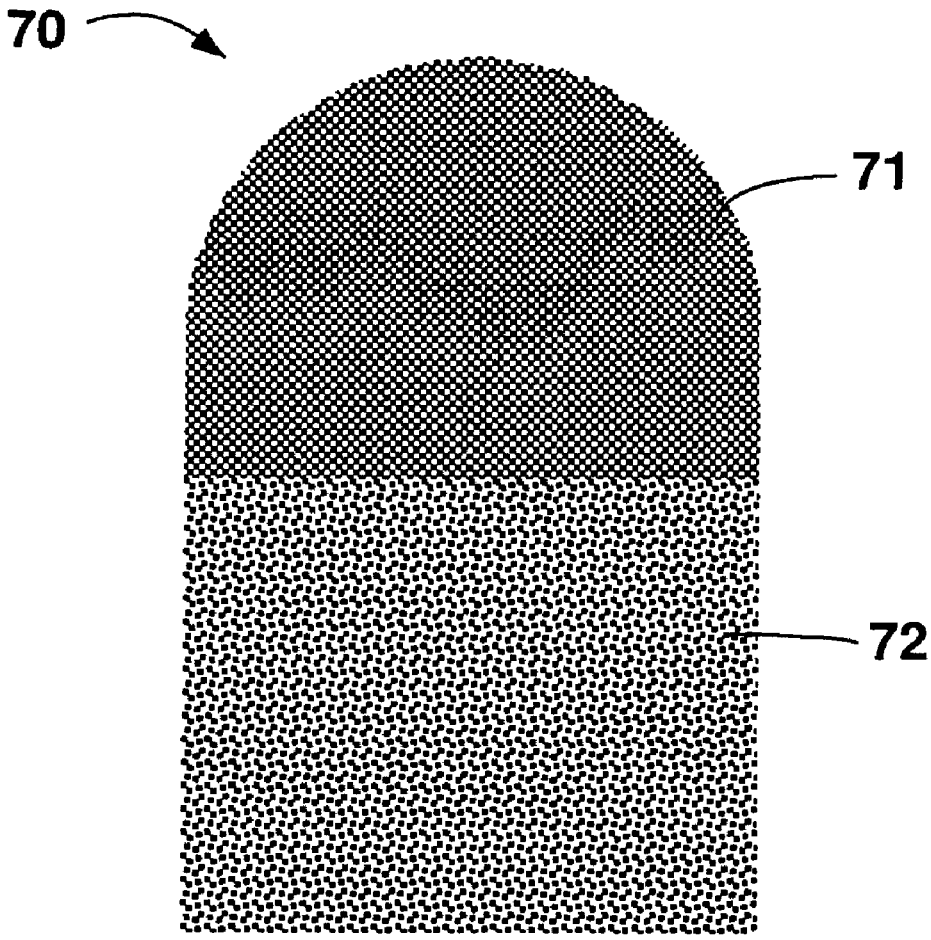
FIG. 7 is a schematic representation of the cutting insert 70 of the present invention comprising a cutting zone 71 of virgin cemented carbide and a body zone 72 comprising a recycled cemented carbide grade.

The service life of an earth-boring bit can be significantly enhanced if the wear of the top half of the dome can be retarded without compromising the toughness (or breakage resistance) of the cutting inserts. Furthermore, significant cost reductions can be achieved if the inserts could be fabricated using and recycled materials. Such an embodiment of a cutting insert is shown in FIG. 7. The cutting insert 70 includes a cutting zone 71 manufactured from a virgin cemented carbide and a body zone 72 manufactured from recycled cemented carbide. In this embodiment, the cutting zone 71 comprises all of the dome of the cutting insert 80 and a portion of the cylindrical body zone. One skilled in the art would understand that the cutting zone may comprise any desired percentage of the volume of the entire cutting insert and is not limited to the percentage, shape, or design shown in FIG. 7.

Embodiments of the cutting inserts for drilling bits of the present invention may comprise at least one zone comprising recycled cemented carbides. For example, tungsten and other valuable constituents of certain cemented carbides may be recovered by treating most forms of tungsten containing scrap and waste. In addition, embodiments of the present invention include methods of preparing a cutting insert for an earth-boring bit, comprising pressing a first cemented carbide powder and a second cemented carbide in a mold to form a green compact, wherein at least one of the first cemented carbide and the second cemented carbide comprise a recycled cemented carbide, and sintering the green compact.

Worn but clean cemented carbide articles comprising particles of transition metal carbides in a binder, such as worn or broken cutting inserts and compacts, may be recycled to produce a transition metal powder. Cemented carbide scrap may be recycled by a variety of processes including direct conversion, binger leaching, and chemical conversion. Direct conversion into graded powder ready for pressing and resintering is typically only performed with sorted hard metal scrap. The zinc process, a direct conversion process well known in the art, comprises treating the clean cemented carbide articles with molten zinc typically at a temperature between 900° C. and 1000° C. The molten zinc dissolves the binder phase. Both the zinc and binder are subsequently distilled under vacuum from the hard metal at a temperature between 900° C. and 1000° C., leaving a spongy hard metal material. The spongy material may be easily crushed, ball-milled, and screened to form the recycled transition metal powder.

The coldstream process is another direct conversion recycle process. The coldstream process typically comprises accelerating cleaned and sorted hardmetal scrap, such as cemented carbides, in an airjet. The hardmetal scrap is crushed through impact with a baffle plate. The crushed hard metal is classified by screens, cyclones, and/or filters to produce the graded hardmetal powder ready for use. For brittle hardmetals with low binder content, direct mechanical crushing is also an alternative direct conversion method of recycling.

Leaching processes are designed to chemically remove the binder from between the metal carbide particles while leaving the metal carbide particles intact. The quality and composition of the starting material used in the leaching process determines the quality of the resulting recycled carbide material.

Contaminated scrap may be treated in a chemical conversion process to recover of the cemented carbide constituents as powders. A typical chemical conversion process includes oxidation of the scrap at a temperature in the range of 750° C. to 900° C. in air or oxygen. The oxidized scrap is the subjected to a pressure digestion process with sodium hydroxide (NaOH) at 200° C. and 20 bar for 2 to 4 hours. The resulting mixture is filtered and, subsequently, precipitation and extraction steps are performed to purify the metal carbide. Finally, conventional carbide processing steps are performed, such as, calzination, reduction, and carburization, to produce the metal carbide powder for use in producing recycle cemented carbide articles. The recycled transition metal powder may be used in the manufacturing process for the production of any of the articles of the present invention.

EXAMPLES

Example 1

FIG. 3(*a*) shows an embodiment of a cutting insert 30 of the present invention having a cutting zone 31 comprising a cemented carbide grade having a Co content of 10 weigh percent and an average WC grain size of 0.8μm. The cutting zone 31 has a hardness of 92.0 HRA. The second zone, the body zone 32, comprises a cemented carbide grade having a Co content of 10 weigh percent and an average WC grain size of 3.0 μm. The body zone 32 has a hardness of 89.0 HRA. FIGS. 3(*b*)-3(*d*) illustrate the microstructures of the cutting zone (FIG. 3(*b*)), the transition zone between the cutting zone 31 and the body zone 32 (FIG. 3(*c*)), and the body zone 32(FIG. 3(*d*)), respectively. FIG. 3(*e*) illustrates the exterior of the insert.

The insert of example 1 was fabricated by filling a portion of the dome of the lower punch with the first cemented carbide powder corresponding to the cutting zone, followed by raising the die table and filling the mold with powder grade corresponding to the body zone 32. The entire powder volume was pressed and liquid phase sintered as a single piece.

Example 2

FIG. 4(*a*) shows an embodiment of a cutting insert 41 of the present invention having a cutting zone 41 comprising a cemented grade having a Co content of 6 weigh percent and an average WC grain size of 1.5μm. The resultant cutting zone 41 has a hardness of 92.0 HRA. The body zone 42 comprises a cemented carbide grade having a Co content of 10 weigh percent and an average WC grain size of 3.0 μm. The body zone has a hardness of 89.0 HRA. FIGS. 4(*b*)-4(*d*) illustrate the microstructures of the cutting zone 41 (FIG. 4(*b*)), the transition zone between the cutting zone 41 and the body zone 42 (FIG. 4(*c*)), and the body zone 42 respectively. FIG. 4(*e*) illustrates the exterior of the insert.

The fabrication method employed for the inserts of example 2 was similar to the one employed for example 6.

Example 3

FIG. 5(*a*) shows an embodiment of an insert 50 having a cutting zone 51 based on a hybrid cemented carbide grade consisting of a mixture of two cemented carbide grades. The discontinuous phase with the cutting zone 51 is a first grade comprises 35 weigh percent of the cutting zone 51, and is a cemented carbide grade having a Co content of 10 weigh percent, an average grain size of 0.8 μm, and a hardness of 92.0 HRA. The continuous phase second grade of the hybrid cemented carbide comprises the remaining 65 weigh percent of the cutting zone 51 and is a cemented carbide grade having a Co content of 10 weigh percent, an average WC grain size of 3.0 μm, and a hardness of 89.0 HRA.

The body zone 52 of the cutting insert 50 of FIG. 5(*a*) comprises a cemented carbide grade having a Co content of 10 weigh percent and an average WC grain size of 3.0 μm. The resultant body zone 52 has a hardness of 89.0 HRA. FIGS. 5(*b*)-5(*d*) illustrate the microstructures of the cutting zone (FIG. 5(*b*)), the transition zone between the cutting zone 51 and the body zone 52 (FIG. 5(*c*)), and the body zone (FIG. 5(*d*)) respectively. FIG. 5(*e*) illustrates the exterior of the insert.

The fabrication method employed for the inserts of example 3 was similar to the one employed for example 1 with the exception of using a hybrid cemented carbide in the cutting zone 51.

Example 4

FIG. 6(*a*) shows an embodiment of an insert 60 of the present invention having a cutting zone 61 based on a grade having a Co content of 6 weight percent and an average WC grain size of 1.5 μm. The cutting zone 61 has a hardness of 92.0 HRA. The body zone 62 is based on a cemented carbide grade having a Co content of 10 weigh percent and an average WC grain size of 3.0 gm. The body zone 62 has a hardness of 89.0 HRA. FIGS. 6(*b*)-6(*d*) illustrate the microstructures of the cutting zone 61 (FIG. 6(*b*)), the transition zone between the cutting zone 61 and the body zone 62 (FIG. 6(*c*)), and the body zone 62 (FIG. 6(*d*)) respectively. FIG. 6(*e*) illustrates the exterior of the insert 60.

The fabrication method employed for example 4 consisted of pressing a green compact from the cemented carbide grade of the cutting zone, placing the pre-pressed green compact on the lower punch, raising the die table and filling the mold with the cemented carbide powder grade corresponding to the body zone, followed by pressing the powder and sintering as one piece.

Example 5

The cutting insert 70 of example 5 was made with a cutting zone 71 comprising a cemented carbide grade having a Co content of 10 weight percent and an average WC grain size of 5.0 μm. The grade of the cutting zone 71 was prepared using virgin raw materials. The cutting zone has a hardness of 87.5 HRA. The body zone 72 comprises a cemented grade having a Co content of 11 weight percent and an average WC grain size of 4.5 μm. The cemented carbide grade of the body zone 72 was prepared using recycled raw materials and is considerably lower in cost compared with the cemented carbide grade used in the cutting zone. The resultant body zone has a hardness of 88.0 HRA. FIG. 7 schematically illustrates the configuration of the insert of example 5. Either of the fabrication methods used for examples 1 through 4 may be used for fabricating the inserts of example 5.

It is to be understood that the present description illustrates those aspects of the invention relevant to a clear understanding of the invention. Certain aspects of the invention that would be apparent to those of ordinary skill in the art and that, therefore, would not facilitate a better understanding of the invention have not been presented in order to simplify the present description. Although embodiments of the present invention have been described, one of ordinary skill in the art will, upon considering the foregoing description, recognize that many modifications and variations of the invention may be employed. All such variations and modifications of the invention are intended to be covered by the foregoing description and the following claims.

The invention claimed is:

1. A cutting insert for an earth-boring drill bit, comprising:

a body zone comprising a conventional first cemented carbide; and a cutting zone comprising a hybrid cemented carbide comprising particles of a second cemented carbide dispersed throughout a continuous phase of a third cemented carbide.

2. The cutting insert of claim 1, wherein the second cemented carbide has at least one property that is different than the third cemented carbide.

3. The cutting insert of claim 1, wherein a contiguity ratio of the particles of the second cemented carbide dispersed in the continuous phase of the third cemented carbide is less than or equal to 0.48.

4. The cutting insert of claim 2, wherein a hardness of the second cemented carbide is greater than hardness of the third cemented carbide continuous phase.

5. The cutting insert of claim 4, wherein the hardness of the second cemented carbide is greater than or equal to 88 HRA and less than or equal to 95 HRA and the hardness of the third cemented carbide continuous phase is greater than or equal to 78 HRA and less than or equal to 91 HRA.

6. The cutting insert of claim 1, wherein a volume fraction of the second cemented carbide is less than 50 volume percent of the hybrid cemented carbide and the contiguity ratio of the second cemented carbide is less than or equal to 1.5 times a volume fraction of the third cemented carbide.

7. The cutting insert of claim 1, wherein each of the first cemented carbide, the second cemented carbide, and the third cemented carbide individually comprise transition metal carbides in a binder.

8. The cutting insert of claim 7, wherein the binder of each of the first cemented carbide, the second cemented carbide, and the third cemented carbide independently comprise at least one metal selected from cobalt, nickel, iron, alloys of cobalt, alloys of iron, and alloys of nickel.

9. The cutting insert of claim 7, wherein the transition metal carbides of each of the first cemented carbide, the second cemented carbide, and the third cemented carbide independently comprise at least one transition metal carbide selected from titanium carbide, chromium carbide, vanadium carbide, zirconium carbide, hafnium carbide, tantalum carbide, molybdenum carbide, niobium carbide, and tungsten carbide.

10. The cutting insert of claim 9, wherein the transition metal carbides of each of the first cemented carbide, the second cemented carbide, and the third cemented carbide comprise tungsten carbide.

11. The cutting insert of claim 7, wherein each of the first cemented carbide, the second cemented carbide, and the third cemented carbide comprise tungsten carbide particles in a cobalt binder.

12. The cutting insert of claim 8, wherein the binder further comprises an alloying agent selected from tungsten, titanium, tantalum, niobium, chromium, molybdenum, boron, carbon, silicon, ruthenium, rhenium, manganese, aluminum, and copper.

13. The cutting insert of claim 7, wherein the binder of each of the first cemented carbide, the second cemented carbide, and the third cemented carbide comprises cobalt.

14. The cutting insert of claim 1, wherein the cutting zone and the body zone differ in at least one property selected from the group consisting of modulus of elasticity, hardness, wear resistance, fracture toughness, tensile strength, corrosion resistance, coefficient of thermal expansion, and coefficient of thermal conductivity.

15. The cutting insert of claim 7, wherein a chemical composition of the binder of at least one of the first cemented carbide, the second cemented carbide, and the third cemented carbide differs from the chemical composition of the binder of one other of the first cemented carbide, the second cemented carbide, and the third cemented carbide.

16. The cutting insert of claim 7, wherein a weight percentage of binder in at least one of the first cemented carbide, the second cemented carbide, and the third cemented carbide differs from a weight percentage of binder in at least one other of the first cemented carbide, the second cemented carbide, and the third cemented carbide.

17. The cutting insert of claim 7, wherein at least one of chemical composition and average grain size of the transition metal carbide of at least one of the first cemented carbide, the second cemented carbide, and the third cemented carbide differs from one other of the first cemented carbide, the second cemented carbide, and the third cemented carbide.

18. The cutting insert of claim 7, wherein each of the first cemented carbide, the second cemented carbide, and the third cemented carbide individually comprise 2 to 40 weight percent of the binder and 60 to 98 weight percent of the transition metal carbide.

19. The cutting insert of claim 7, wherein at least one of the first cemented carbide, the second cemented carbide, and the third cemented carbide comprise tungsten carbide particles having an average grain size of 0.3 to 10μm.

20. The cutting insert of claim 7, wherein at least one of the first cemented carbide, the second cemented carbide, and the third cemented carbide comprises tungsten carbide particles having an average grain size of 0.5 to 10 μm, and at least one other of the first cemented carbide, the second cemented carbide, and the third cemented carbide comprises tungsten carbide particles having an average particle size of 0.3 to 1.5 μm.

21. The cutting insert of claim 7, wherein at least one of the first cemented carbide, the second cemented carbide, and the third cemented carbide comprises 1 to 10 weight percent more of the binder than at least one other of the first cemented carbide, the second cemented carbide, and the third cemented carbide.

22. The cutting insert of claim 1, wherein a modulus of elasticity of the cutting zone differs from the modulus of elasticity of the body zone.

23. The cutting insert of claim 1, wherein hardness of the cutting zone is from 90 to 94 HRA and hardness of the body zone is from 85 to 90 HRA.

24. The cutting insert of claim 1, wherein at least one of hardness and wear resistance of the cutting zone and the body zone differ.

25. The cutting insert of claim 7, wherein at least one of the first cemented carbide, the second cemented carbide, and the third cemented carbide comprises 6 to 15 weight percent cobalt alloy and at least one other of the first cemented carbide, the second cemented carbide, and the third cemented carbide comprises 10 to 15 weight percent cobalt alloy.

26. The cutting insert of claim 1, wherein at least a portion of cemented carbide in at least one of the first cemented carbide, the second cemented carbide, and the third cemented carbide is recycled cemented carbide.

27. The cutting insert of claim 1, further comprising at least one additional zone.

28. The cutting insert of claim 27, wherein the at least one additional zone is selected from the group consisting of a central axis support zone, a bottom zone, and a transitional zone.

* * * * *